US005413251A

United States Patent [19]

Adamson

[11] Patent Number: 5,413,251

[45] Date of Patent: May 9, 1995

[54] LIQUID DISPENSING WITH DUAL RESERVOIR DELIVERY SYSTEM

[76] Inventor: David J. Adamson, 770 N. Main St., Alpine, Utah 84004

[21] Appl. No.: 134,543

[22] Filed: Oct. 12, 1993

[51] Int. Cl.[6] ..... B67D 5/56

[52] U.S. Cl. ..... 222/129; 222/153.03; 222/181; 222/383.1

[58] Field of Search ..... 222/129, 153, 181, 383

[56] References Cited

U.S. PATENT DOCUMENTS

| | | | |
|---|---|---|---|
| 3,200,994 | 8/1965 | Levinson | 222/82 |
| 3,349,967 | 10/1967 | Schneller | 222/130 |
| 4,874,113 | 10/1989 | Schmidt | 222/181 X |
| 4,880,145 | 11/1989 | McManus | 222/192 |
| 4,998,647 | 3/1991 | Sharp | 222/143 |
| 5,131,568 | 7/1992 | Ringuette | 222/383 X |
| 5,183,182 | 2/1993 | Comstock et al. | 222/129 |
| 5,253,786 | 10/1993 | Schmidt | 222/153 |

FOREIGN PATENT DOCUMENTS

| | | | |
|---|---|---|---|
| 0194417 | 9/1986 | European Pat. Off. | 222/383 |

*Primary Examiner*—Andres Kashnikow
*Assistant Examiner*—Joseph A. Kaufman
*Attorney, Agent, or Firm*—Prince, Yeates & Geldzabler

[57] ABSTRACT

A liquid dispensing device incorporates a housing for mounting on a shower, bath enclosure, or other appropriate wall. The housing houses a plurality of refillable and sealable bottles that conform to the interior contour of the housing in order to maintain a narrow and streamlined profile to the housing. Each of the bottles comprises a supply reservoir, a dispensing reservoir, a transition area connecting the two reservoirs, and a dispensing pump mechanism that dispenses a measured amount of fluid from the dispensing reservoir. The pump injects an amount of ambient pressure air into the closed bottle equal to the amount of liquid dispensed, with each dispensing cycle, to equalize and maintain the pressures inside and outside the bottle to prevent collapse of the bottle as liquid is withdrawn. This equalization of pressure prevents liquid from inadvertently seeping through the pump under its own weight.

8 Claims, 4 Drawing Sheets

LIQUID DISPENSING WITH DUAL RESERVOIR DELIVERY SYSTEM

BACKGROUND OF THE INVENTION

1. Field of the Invention

The present invention relates to liquid dispensers, and more particularly relates to a wall-mountable dispenser having removable and reusable (refillable) liquid dispensing bottles therein.

2. Description of Related Art

To shower or bathe, it is convenient to have close at hand a liquid dispenser for soap, shampoo, conditioner, hand lotion, etc. for use in the shower or bath. A number of devices presently exist for installing in the shower or bath, either on the wall or suspended from the shower head, for holding and dispensing these personal hygiene items. Some of these devices include a plurality of gravity flow reservoirs that incorporate dispensing valve mechanisms at the bottom thereof, in addition to a rack for holding shower, bath, and other personal hygiene items, as in bar soap, shaver, etc. One related prior art device incorporates a mirror, illuminating light, radio, and a number of replaceable liquid dispensers. Other devices incorporate box assemblies for holding a plurality of liquid containers, each having a top-mounted pump mechanism that withdraws liquid from the bottom of the container, as in many conventional dispenser bottles. In addition, one prior art device utilizes gas pressure from an enclosed pressurized tank for forcing liquid out of the container, and for preventing the container from drawing air back therein due to atmospheric pressure.

SUMMARY OF THE INVENTION

The present invention is directed to a liquid dispensing device for mounting on a wall, the device incorporating a plurality of refillable and sealable bottles that conform to the shape of the wall-mounted back plate and detachable front cover. Each of the bottles includes a dual reservoir delivery system which comprises a first supply reservoir, and a second dispensing reservoir into which the liquid gravity flows from the supply reservoir. A pump mechanism communicates with the dispensing reservoir for withdrawing the liquid therefrom. The pump mechanism injects a volume of air at ambient pressure equal to the volume of liquid withdrawn from the second reservoir. This volume of air then makes its way upwardly into the supply reservoir for equalizing the pressure therein, and permitting a like volume of liquid to flow from the supply reservoir into the dispensing reservoir.

DESCRIPTION OF THE PREFERRED EMBODIMENT

Figure 1:
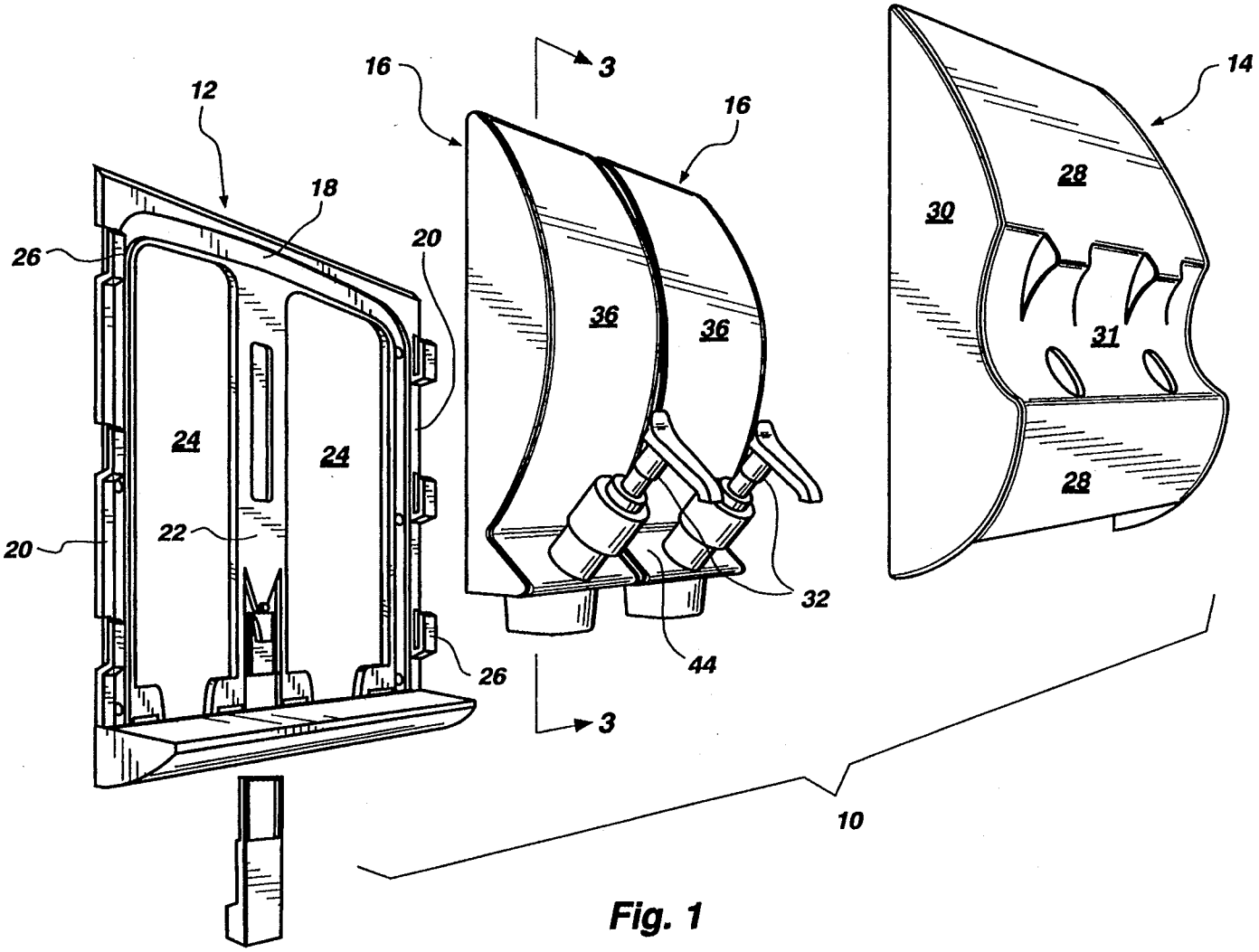
FIG. 1 is a perspective exploded front view of the components of the liquid dispensing device of the present invention.

Turning now to the drawings, and initially to FIG. 1, the liquid dispensing device of the present invention is shown in exploded perspective, generally illustrated by the numeral 10. The dispensing device comprises three major elements: (1) a rectangular back plate 12; (2) a front cover 14 adapted for quick attachment to and removal from the back plate; and (3) at least one, and preferably a plurality of, refillable, sealable bottles 16, configured to confirm to the interior contours of the back plate and the front cover.

The back plate 12 is adapated for screw- or adhesive-mounting to a vertical wall in a customary manner. The back plate 12 is commercially fabricated of plastic, and comprises a generally planar section 18, having two vertical and parallel edge structural braces 20 that cooperate with a central brace 22 to define two essentially rectangular openings or voids 24 that receive therein rearwardly expanded sections of respective bottles 16, as are better illustrated in FIGS. 2, 3, and 4, and will be described in more detail hereinbelow. In the embodiment shown, the liquid dispensing device includes two sealable bottles 16; therefore, the planar section 18 of the back plate includes two corresponding openings 24.

The planar section 18 of the back plate includes a plurality of hooks 26 on the two structural edges 20 thereof to enable the front cover 14 to be functionally attached thereto by positioning the front cover directly over, and slightly above, the back plate, thereafter sliding the front cover downward to enable mating tabs (not clearly shown in FIG. 1) on the front cover to catch on the hooks to retain the front cover in position.

The front cover 14 incorporates an aesthetically pleasing outwardly curved front surface 28 that is connected to essentially straight and vertical side panels 30 to define the outer contours of the cover. The curved front surface 28 also includes an intermediate inwardly curved surface 31 that defines a recessed portion of the front cover, and having holes through which the pump mechanisms 32 of the respective bottles 16 extend for access thereto.

Figure 2:
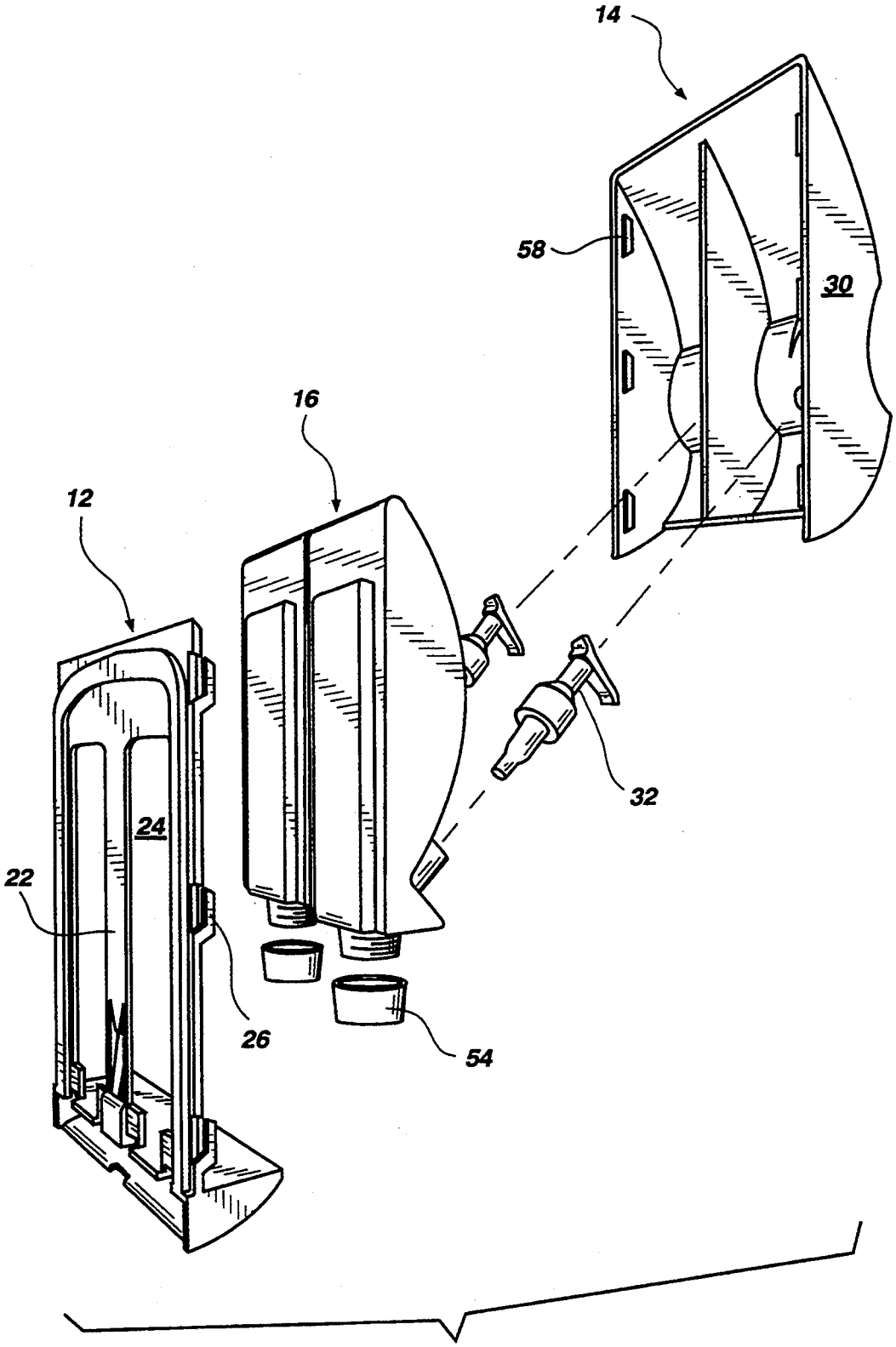
FIG. 2 is a perspective exploded rear view of the components of the liquid dispensing device.
Figure 4:
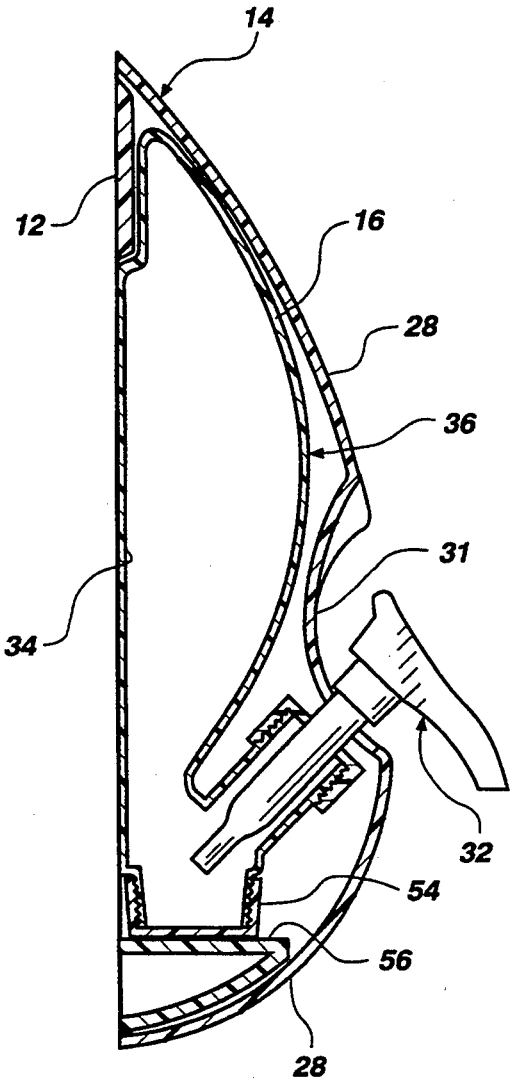
FIG. 4 is a vertical sectional view through the assembled back plate, bottle, and cover of the liquid dispensing device.

As best shown in FIGS. 2 and 4, the refillable and sealable bottles 16 conform to the contours of both the back plate 12 and the front cover 14. Each of the bottles 16 includes the rearwardly portruding section 34 that is adapted to fit into a respective opening 24 in the back plate 12. This design aids in maximizing the available interior volume of the bottle 16, while simultaneously permitting the front cover 14 to maintain a slim profile. The bottle front surface 36 likewise is designed to conform to the interior contour of the cover outwardly curved front surface 28, again to aid in maximizing the usable volume of the bottle, while enabling the liquid dispensing device to maintain a narrow profile.

Figure 3:
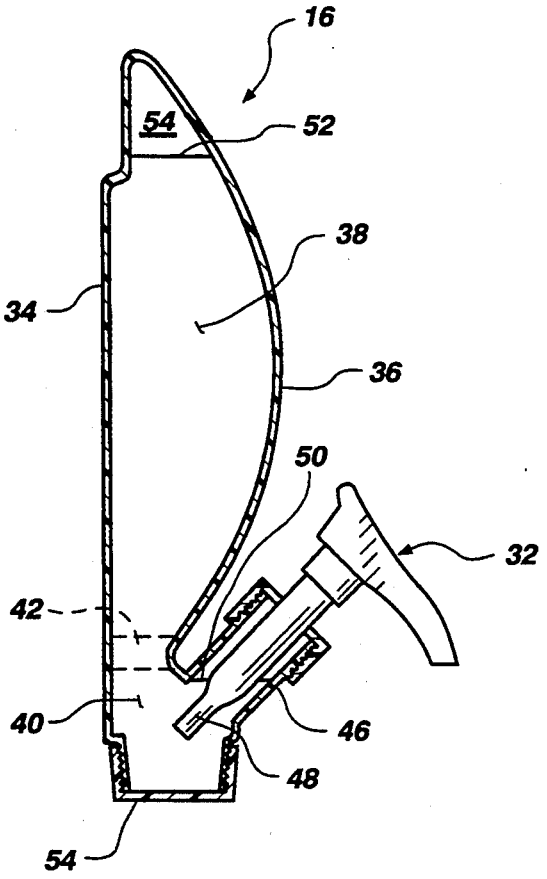
FIG. 3 is a vertical sectional view taken along lines 3—3 in FIG. 1, showing the interior relationship of the two reservoirs and pump mechanism of the liquid bottle.

Turning specifically to FIG. 3, a bottle 16 is shown in vertical section taken through the pump mechanism 32.

The bottle comprises two fluid reservoirs, a first or supply reservoir 38 and a second or dispensing reservoir 40. These reservoirs 38 and 40 are separated by transition area 42, defined by a narrowing of the transition from the bottle front contoured surface 36 to a lower angled surface 44 (best shown in FIG. 1) to which the pump mechanism 32 is indirectly mounted.

The lower angled surface 44 of the bottle includes a nozzle 46 to which the pump mechanism 32 is attached in a customary manner. The nozzle 46 is essentially normal to the angled surface 44, and is oriented at an angle to permit convenient use thereof by the user. The pump mechanism 32 is a conventional, commercially-available unit that expels liquid on the down or compression stroke, and subsequently draws liquid into the pump chamber thereof on the spring-actuated up stroke. As is customary, the pump mechanism 32 includes a suction tube 48 that extends down into the lowermost portion of the dispensing reservoir 40 to enable the pump mechanism to draw liquid therefrom.

This pump mechanism 32 is of a type that "breathes"; that is, during the up stroke in which liquid is drawn up into the pump chamber through the suction tube, an equivalent volume of air is introduced into the dispensing reservoir through the pump mechanism in order to equalize pressure inside and outside of the bottle, and prevent collapse of the bottle as liquid is dispensed therefrom during use. This air introduced into the bottle through the pump mechanism, of course, accumulates above the level 50 of the liquid within the dispensing reservoir 40.

The dispensing reservoir and supply reservoir are so designed such that, when the liquid level 50 in the dispensing reservoir (because of the introduction of air through the pump mechanism) drops down to the lower-most point in the reservoir transition area 42, an air bubble is permitted to "burp" around the sharply curved portion of the reservoir transition area from the dispensing reservoir to the supply reservoir. This "burping" air bubble equalizes the pressure within the supply reservoir, then makes its way to the top of the reservoir, above the liquid level 52 in the supply reservoir to permit fluid in the supply reservoir to drop down under gravity-feed, through the reservoir transition area 42 and into the dispensing reservoir 40. In this manner, the pressure within the bottle is constantly maintained at approximately atmospheric pressure, without collapsing the bottle, while utilizing the vacuum effect in the area 54 above the liquid level in the supply reservoir to prevent the liquid in the bottle from flowing through and out the pump mechanism 32 under its own weight.

FIG. 4 is a vertical sectional view taken through the assembled liquid dispensing device, illustrating how the bottles fit within the front cover and back plate, with the pump mechanisms extending through the recessed portion 31 of the outwardly curved front surface 28 of the front cover. The bottles rest upside down, i.e., with the neck and cap 54 at the bottom resting on the vertical ledge 56 of the back plate, with the rearwardly portruding section 34 of the bottle nesting within the opening 24 of the back plate.

The liquid dispensing device of the present invention is assembled in the following procedure. With the pump mechanisms 32 in place upon the bottle nozzles 46, the user pours chosen liquids (shampoo, conditioner, liquid soap, hand lotion, etc.) into the bottle and tightly replaces the caps. He next positions the bottles within the front cover, making sure that the pump mechanisms portrude through the pump mechanism openings in the recessed portion 31. So positioned, the bottles will remain in the front cover as the front cover is installed on the back plate.

To install the cover on the back plate, the user positions the cover, with the bottles inside, directly against, and slightly above (as shown in the drawings) the back plate. He slides the cover down until the hooks 26 on the back plate engage mating tabs 58 on the front cover, and then further pushes the front cover down until the bottle cap rests on the horizontal ledge of the back plate, at which time a spring-operated locking mechanism locks the front cover to the back plate. This locking mechanism is shown more clearly in FIGS. 5, 6A, and 6B.

As the front cover is slid into position on the back plate, the rearwardly portruding section 34 of the bottle shifts into its receiving area defined by the opening 24 in the back plate. In addition to increasing the fluid volume of the bottle, this rearwardly portruding section 34 rests directly against the surface of the wall to which the liquid dispensing device is mounted, thereby providing a positive engagement with a solid surface to provide support and resistance to the force applied by the user in pressing down and toward the wall on the pump mechanism to dispense a measured volume of liquid.

Figure 5:
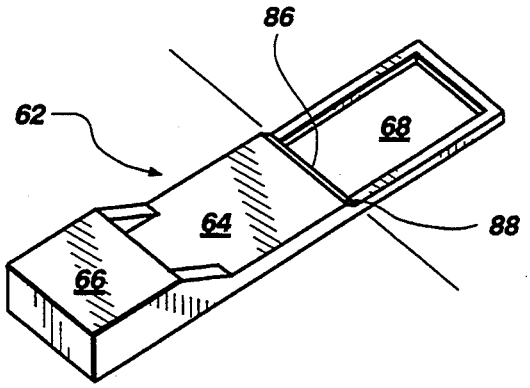
FIG. 5 is a perspective view of the locking mechanism key.
Figure 6A:
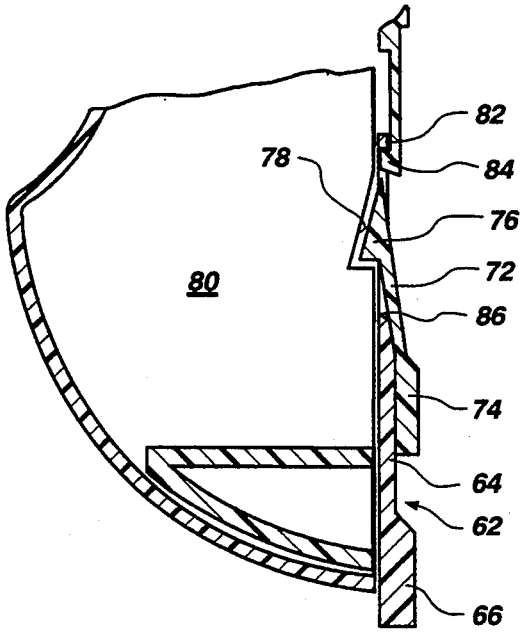
FIG. 6A is a partial, vertical sectional view through the back plate, front cover, and locking key illustrating the locking mechanism, with the key in its down, "locked" position.
Figure 6B:
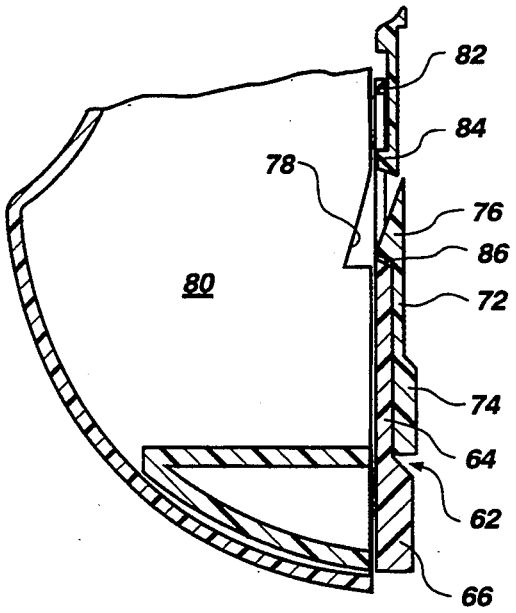
FIG. 6B is a partial, vertical sectional view through the back plate, front cover, and locking key illustrating the locking mechanism, with the key in its up, "unlocked" position.

FIGS. 5, 6A, and 6B illustrate the locking mechanism for the front cover and back plate of the liquid dispensing device. FIG. 5 is a perspective view of a key 62 used to unlock the front cower from the back plate. As shown, the key 62 comprises a generally planar section 64 having a griping portion 66 at one end and a rectangular through hole 68 at the other end. The key 62 is essentially rectangular in cross-section and is adapted to slide axially in a rectangular channel formed in the back plate 12.

FIGS. 6A and 6B are vertical sectional views through the locking interface of the back plate 12 and the front cover 14. The locking mechanism comprises a resiliant finger 72 attached to the bottom panel 74 of the back plate 12 at the lower end thereof, the resiliant finger having a triangular shaped latch 76 formed at the top thereof. The finger 72 and latch 76 are biased in the direction away from the wall and toward the front portion of the front cover 14, to the left as shown in FIGS. 6A and 6B.

When the front cover is locked into position, as shown in FIG. 6A, the triangular shaped latch 76 engages a mating detent 78 formed in the center dividing wall 80 of the front cover in a manner to prevent the front cover from being shifted upwardly to detach the cover from the back plate.

As shown in FIGS. 6A and 6B, the key 62 is vertically slidable in its rectangular channel, between a "locking" position, as shown in FIG. 6A, and an "unlocking" position, as shown in FIG. 6B, when the key is pushed upwardly against the locking mechanism finger and latch.

When the front cover 14 is in functional position relative to the back plate 12, the detent 78 in the front cover dividing wall 80 and the finger latch 76 of the back plate (both when "locked" and "unlocked") are positioned within the rectangular through hole 68 of the key. As shown in FIG. 6A, a top portion 82 of the key above the through hole 60 rests on a projecting tab 84 which projects toward the front of the front cover from the center brace 22 of the frame of the back plate to retain the key within its rectangular channel and prevent it from falling out. It can be appreciated, therefore, that the finger latch and detent mechanism function within the through hole of the key.

The key through hole defines a bottom surface 86 that is designed to engage the locking mechanism finger 72 and urge it rearwardly away from the front cover as the key is shifted upwardly to its "unlock" position as shown in FIG. 6B. As can be appreciated, as the key slides upwardly, the through hole bottom surface 86 engages the finger and urges it rearwardly (to the right in FIG. 6B) to retract the latch 76 from the detent 78. With the latch retracted from the detent, the front cover and fluid dispensing bottles therein may be shifted upwardly to release the cover from the back plate hooks 26, and then be totally removed for refilling of the bottles. The key can now be shifted downwardly to its "locked" position, freeing up the finger and latch mechanism to be biased into the detent when the top cover 14 is subsequently reinstalled on the back plate. As can be appreciated, when the cover is slid down into position on the back plate, the latch is biased into the detent to "lock" the cover in place until it is desired to unlock and remove the cover using the key.

There are instances wherein it is desirable to have more control over the removal of the top cover from the back plate. Specifically, in commercial applications, it is desirable to prevent the cover from being removed without authorization. Therefore, the key 62 is designed to be removed from the device, if desired, thereby preventing unauthorized removal of the front cover. In order to remove the key, breaklines 88 have been provided adjacent the through hole bottom surface 86 that engages the locking mechanism finger, to enable the top portion of the key (the "U" defining the through hole) to be readily broken off and discarded. A key thus modified can easily be inserted into the rectangular channel and urged upwardly to engage the locking mechanism finger, pushing it rearwardly (to the right as shown in FIGS. 6A and 6B) to release the latch from the detent, as previously described. The difference, however, is that, without the top portion 82 of the key being retained by the tab 84, the key can be removed once the front cover is "unlocked" from the back plate and shifted upwardly slightly so that the detent 78 clears the triangular shaped latch 76. In this manner, the liquid dispensing device of the present invention can be used in commercial applications in which it is desired to limit access to the refillable bottles inside.

From the foregoing, it will be seen that this invention is one well adapted to attain all of the ends and objectives herein set forth, together with other advantages which are obvious and which are inherent to the apparatus. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

What is claimed is:

1. A liquid dispensing device for wall mounting, comprising:

(a) a substantially rectangular back plate for mounting on a wall;

(b) a cover adapted for quick attachment to and removal from said back plate; and (c) a refillable, bottle adapted to conform to the interior contours of said back plate and said cover, and mountable in functional position within said cover, said bottle being sealed at all times except when dispensing liquid therefrom, said bottle comprising:

(1) a first reservoir for holding a supply of liquid therein; and (2) a second reservoir positioned vertically below and in communication with said first reservoir for vacuum-pressure-controlled gravity-feed of liquid from said first reservoir to said second reservoir, said second reservoir including a pump for withdrawing liquid from said second reservoir, said second reservoir including a dispensing nozzle area for receiving successive volumes of air introduced thereinto by said pump, and metering these volumes of air into said first reservoir to replace like volumes of liquid migrating from said first reservoir to said second reservoir for subsequent dispensing.

2. A liquid dispensing device as set forth in claim 1, wherein said bottle includes a closable aperture for permitting manual refilling thereof with liquid.

3. A liquid dispensing device as set forth in claim 2, wherein said aperture is in communication with said second reservoir.

4. A liquid dispensing device as set forth in claim 1, further comprising a plurality of fillable, resealable bottles.

5. A liquid dispensing device as set forth in claim 1, wherein said back plate includes a releasable locking mechanism that cooperates with said cover to releasably lock said cover to said back plate.

6. A liquid dispensing device as set forth in claim 5, wherein said locking mechanism automatically locks said cover to said back plate upon attachment of said cover to said back plate.

7. A liquid dispensing device as set forth in claim 6, wherein said locking mechanism includes a key for manually unlocking said locking mechanism.

8. A liquid dispensing device as set forth in claim 7, wherein said key is convertible into a key that is removable from said back plate.

* * * * *